US007240525B2

(12) United States Patent
Sevillano Gil

(10) Patent No.: US 7,240,525 B2
(45) Date of Patent: Jul. 10, 2007

(54) MASTER-KEYED CYLINDER COMPRISING TUMBLERS AND CORRESPONDING MASTER KEY

(75) Inventor: Benito Sevillano Gil, Elgoibar (ES)

(73) Assignee: Ojmar, S.A. (ES)

( * ) Notice: Subject to any disclaimer, the term of this patent is extended or adjusted under 35 U.S.C. 154(b) by 103 days.

(21) Appl. No.: 10/567,596

(22) PCT Filed: Feb. 24, 2004

(86) PCT No.: PCT/ES2004/000083

§ 371 (c)(1),
(2), (4) Date: Feb. 6, 2006

(87) PCT Pub. No.: WO2005/031093

PCT Pub. Date: Apr. 7, 2005

(65) Prior Publication Data

US 2006/0201216 A1 Sep. 14, 2006

(30) Foreign Application Priority Data

Sep. 30, 2003 (ES) ..... 200302254

(51) Int. Cl.
*E05B 35/10* (2006.01)
*E05B 29/06* (2006.01)

(52) U.S. Cl. ..... 70/340; 70/409; 70/492

(58) Field of Classification Search ..... 70/492, 70/409, 376, 377, 337–343, 392, 421, DIG. 1, 70/DIG. 2, DIG. 23, DIG. 25, 495, 378, 70/462

See application file for complete search history.

(56) References Cited

U.S. PATENT DOCUMENTS

| | | | | |
|---|---|---|---|---|
| 1,328,074 A | | 1/1920 | Bennett | |
| 2,035,181 A | * | 3/1936 | Molinare | 70/358 |
| 2,039,126 A | * | 4/1936 | Svoboda | 70/358 |
| 2,358,164 A | | 9/1944 | Honger | |
| 2,829,513 A | | 4/1958 | Fresard et al. | |
| 3,035,433 A | * | 5/1962 | Testa | 70/495 |
| 3,578,371 A | | 5/1971 | Keller | |
| 4,270,372 A | * | 6/1981 | Vonlanthen et al. | 70/406 |
| 5,182,929 A | * | 2/1993 | Myers | 70/337 |
| 5,765,417 A | * | 6/1998 | Bolton | 70/495 |
| 6,308,543 B1 | * | 10/2001 | Yoshizawa | 70/492 |

FOREIGN PATENT DOCUMENTS

| | | |
|---|---|---|
| ES | 1009297 | 8/1989 |
| JP | 11210281 | 8/1999 |

* cited by examiner

*Primary Examiner*—Lloyd A. Gall
(74) *Attorney, Agent, or Firm*—Lucas & Mercanti, LLP

(57) ABSTRACT

Master-keyed pin tumbler lock and relative master-key, where each pin has an inner window with an outer protuberance, which a spring acts upon and an inner projection, which the key acts upon, giving rise to the movement of the pin. The inner projections are at different heights and the pins are placed so that some move in one direction and others in the opposite direction, each pin having, in its inner window, a step placed on the opposite side to that of the inner projection. On one of the sides of the key there is a notch whose minimum width is the distance between the maximum level reached by the projections of the pins that move in one direction and the maximum level reached by those of the pins that move in the opposite direction; on the opposite side they have a double serration combined with the steps of the inner windows of the pins.

3 Claims, 1 Drawing Sheet

Fig. 1
PRIOR ART
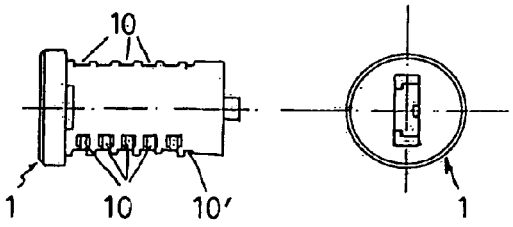
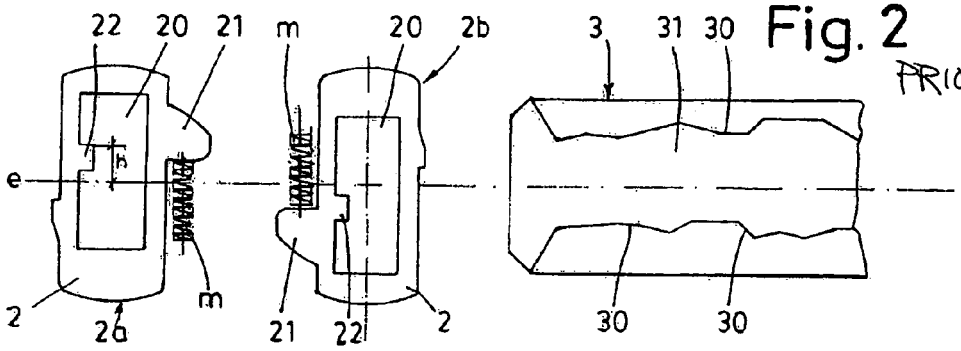
Fig. 2
PRIOR ART
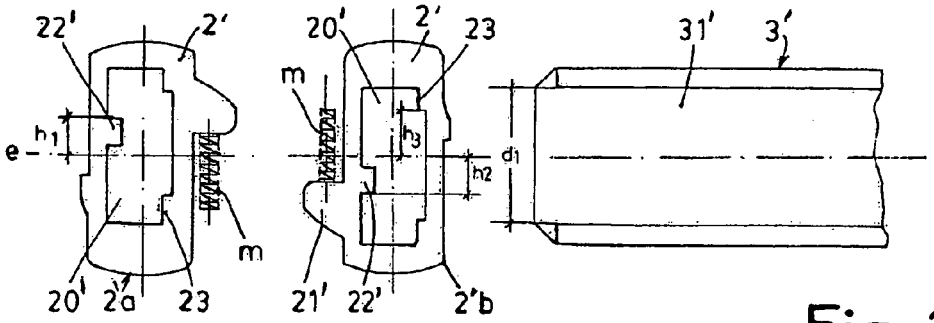
Fig. 3
Fig. 4
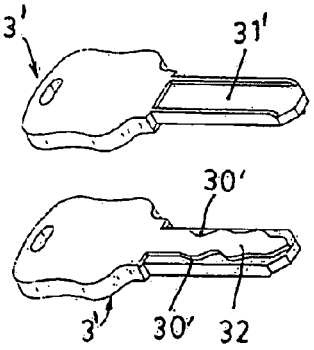

MASTER-KEYED CYLINDER COMPRISING TUMBLERS AND CORRESPONDING MASTER KEY

This invention deals with a master-keyed pin tumbler lock with relative master-key.

In particular, the master-keyed pin tumbler lock is exchangeable and removable, using an extraction key.

Pin tumbler locks are already known, and even removable pin tumbler locks (extractable using an extraction key). Spanish Utility Model 1009297 and U.S. Pat. Nos. 2,829,513 and 1,328,074, for example, are clear precedents that form part of the current state of the technique.

Document U.S. Pat. No. 2,358,164 A, describes a combination of a pin tumbler lock and a key, which has a notch on one its sides whose minimum width is the distance between the maximum level reached by the projections of the pins that move in one direction and the maximum level reached by the projections of the pins that move in the opposite direction. According to this document each pin also has an inner window, another projection placed on the opposite side to that of the inner projection and on the other side, the key has a notch, which combines with the projections of the inner windows of the pins. In another execution all the projections are replaced with grooves or steps and one side of the key has double serration and the other side is smooth.

The main aim of the invention is to "master-key" the pins of the pin tumbler lock.

The relative master-key is also a main aim of the invention, to operate the pin tumbler lock with the "master-keyed" pins.

An additional aim of the invention is for this master-keyed pin tumbler lock to be extractable using a master extraction key.

The key for use is a dual open wave one and it is reversible.

According to the invention, the master-keyed pin tumbler lock, with each pin having an inner window with an outer protuberance upon which a spring acts, and an inner projection on which the key acts, giving rise to the movement of the pin, and the inner projections being at different heights and the pins placed so that some move in one direction and others in the opposite direction, is characterised because each pin has a step on its inner window placed on the opposite side to that of the inner projection.

According to the invention, the master key:

a) has a wave on one of its sides, whose minimum width is the distance between the maximum level reached by the projections of the pins that move in one direction and the maximum level reached by the projections of the pins that move in the opposite direction;

b) on the opposite side, it has a wave with double serration combined with the steps of the inner windows of the pins.

In order to understand the subject of this invention better, a preferential form of practical execution is illustrated on the drawings, subject to incidental changes that take nothing away from its foundation.

BRIEF DESCRIPTION OF THE DRAWINGS

FIG. 1 shows a traditional pin tumbler lock (1) (side view and front view).

FIG. 2 shows both a—left (2*a*)/right (2*b*)—pin in its relative positions and a traditional key (3).

FIG. 3 shows a similar view to FIG. 2, but of a practical execution of the subject of the invention, with a—left (2'*a*)-right (2'*b*)—pin and its master key (3').

FIG. 4 shows a front and rear perspective view of the master key (3) of FIG. 3 subject of the invention.

DETAILED DESCRIPTION OF THE INVENTION

Locks that have a tumbler (1) with a plurality of cavities (10) are already known, where there are self-retained pins (2), some of which (2*a*) act in the opposite direction to the others (2*b*).

The pins (2) are of the kind that have an outer protuberance (21) which a spring (m) acts upon and an inner window (20) with an inner projection (22).

The inner projection (22) of each pin (2) is at the same/different height (h) with respect to an imaginary axis (e).

The traditional key (3) has some protuberances (30) in the channel (31) of each side, combined with the respective inner projections (22) of the pins (2) so that when the key (3) is inserted into the windows (20), the pins (2) move making it possible to open the lock.

In agreement with the invention, two pins (2') are placed for each working channel (10) one left (2'*a*) and other right (2'*b*) placed in such a way in the channel (10) that one (2'*a*) acts in the opposite direction to the other (2'*b*).

In agreement with the invention, each pin (2'*a*), (2'*b*) has a step (23) in its inner window (20') placed on the opposite side to that of the inner projection (22').

These steps (23) are placed in the pins (2') at different heights ($h_3$) with respect to the imaginary axis (e).

The pins (2') have been shown in FIG. 3 with the projections (22') further away from the imaginary axis (e) so that the sum of the absolute values of the heights ($h_1$), ($h_2$) with respect to this imaginary axis have a maximum of: $(h_1+h_2)$ max.

The master key (3') has a channel/wave (31') on one of its sides, whose minimum width ($d_1$) is, at least, equal to the distance between the maximum level ($h_1$) reached by the projections (22') of the pins (2'*a*) that move in one direction and the maximum level ($h_2$) reached by the projections (22') of the pins (2*b*) that move in the opposite direction: $d_1>(h_1+h_2)$.

With this channel/wave (31'), when key (3') is inserted into the window (20') it covers all the internal projections (22') of all the pins (2').

In FIG. 3 the channel/wave (31') has an even width ($d_1$).

On the other side, the master key (3') also has a wave (32) with double serration (30') combined with the steps (23) of the inner windows (20') of the pins (2'*a*), (2'*b*); thus, on this side, the wave (32) has the possibilities of a traditional key with respect to the steps (23).

The drum lock (1) has an additional retaining channel (10') where there is an additional pin, for retaining the drum lock (1). This additional pin is activated by a special master key—not shown—which has the same size and shape as the master key (3'), but which has different (supplementary) cutwork, to be able to act upon this retaining pin and be able to extract the drum lock (1).

The invention claimed is:

1. Master-keyed pin drum lock with relative master key, each pin having an inner window (20) with an outer protuberance (21) which a spring (m) acts upon and an inner projection (22) which the key(3) acts upon giving rise to the movement of the pin (2). (2), the inner projections (22) are at different heights and the pins are placed so that some move in one direction and others in the opposite direction; on one of its sides the key (3) has a notch (31') whose minimum width ($d_1$) is the distance between the maximum level ($h_1$) reached by the projections (22') of the pins (2) which move in one direction and the maximum level ($h_1$) reached by those of the pins that move in the opposite direction; wherein:

a) each pin (2) has a step (23) on its inner window (20) placed on the opposite side to that of the inner projection (22');

b) the key (3) has a double serration (30') on the opposite side to that of the notch (31') combined with the steps (23) of the inner windows (20') of the pins (2'*a*), (2'*b*).

2. Master-keyed pin drum lock with relative master key, according to claim 1 wherein there are some working channels (10) in the drum lock (1) and there are two pins (2'*a*), (2'*b*) per working channel (10) which are inserted into each one of them so that one (2'*a*) acts in the opposite direction to the other (2'*b*).

3. Master-keyed pin drum lock with relative master key, according to claim 1, wherein the drum lock (1) has a retaining channel (10') with an additional pin and the key (3') has a supplementary cutwork which acts upon the retaining pin, making it possible to remove the tumbler lock (1).

* * * * *